US005571349A

United States Patent [19]

Nakazawa et al.

[11] Patent Number: 5,571,349

[45] Date of Patent: Nov. 5, 1996

[54] METHOD OF PRODUCING TWISTED ALUMINUM ARTICLES

[75] Inventors: Yasushi Nakazawa; Hitoshi Kazama, both of Utsunomiyashi; Yasushi Tashiro; Tadashi Yasuoka, both of Oyamashi, all of Japan

[73] Assignees: Honda Giken Kogyo Kabushiki Kaisha, Tokyo; Showa Aluminum Corporation, Osaka, both of Japan

[21] Appl. No.: 358,066

[22] Filed: Dec. 15, 1994

[30] Foreign Application Priority Data

Dec. 17, 1993 [JP] Japan ..... 5-318762

[51] Int. Cl.[6] ..... C22F 1/04

[52] U.S. Cl. ..... 148/690; 148/697; 72/292; 72/371

[58] Field of Search ..... 148/688, 690, 148/698, 697, 439, 440; 72/371, 292; 29/183, 193

[56] References Cited

U.S. PATENT DOCUMENTS

| | | | |
|---|---|---|---|
| 3,104,189 | 9/1963 | Wagner | 148/698 |
| 3,791,876 | 2/1974 | Kroger | 148/690 |
| 3,883,371 | 5/1975 | Geary | 29/183 |

FOREIGN PATENT DOCUMENTS 4-123815 4/1992 Japan .

*Primary Examiner*—Sikyin Ip

*Attorney, Agent, or Firm*—Armstrong, Westerman, Hattori, McLeland & Naughton

[57] ABSTRACT

In a method of producing twisted aluminum products, an elongate heat-treatable aluminum article is twisted at first to have a value "tan $\phi$" of 0.5 or more, with the term $\phi$ denoting a helical angle of the thus twisted article. The twisted aluminum article is then subjected to a solid solution treatment and the step of aging, in this order.

12 Claims, 3 Drawing Sheets

METHOD OF PRODUCING TWISTED ALUMINUM ARTICLES

BACKGROUND OF THE INVENTION

The present invention relates to a method of producing twisted aluminum articles that are usable as the parts of an automobile chassis or as the parts of a machine.

The word 'aluminum' used herein is meant to include aluminum and its alloys.

Aluminum is light in weight and resistant to corrosion that many parts of a variety of machines such as automobile vehicles are made of aluminum. In some cases, twisted aluminum articles are needed to meet certain technical requirements.

A raw material for manufacturing such twisted articles is generally a heat-treated (or heat-treatable) aluminum. The raw material has been subjected at first to the so-called 'solid solution treatment' for example of the T4 type, before twisted and subsequently aged.

The sequence of the solid solution treatment, the and the aging carried out in this order has significantly been impairing impact strength and elongation of the twisted portions in final products.

OBJECTS OF THE INVENTION

An object of the present invention is therefore to provide a method of producing twisted aluminum articles whose twisted portions are improved in shock-absorbing property and elongation.

Another object is to provide twisted aluminum articles adapted for use as the parts of an automobile chassis or any other machine.

The present inventors have conducted a series of researches and discovered a fact that the twisting of a raw aluminum material should precede the solid solution treatment and the aging thereof in order to achieve the objects.

The method provided herein to produce twisted aluminum products comprises the steps of twisting an elongate heat-treatable aluminum article to have the value "tan $\phi$" ($\phi$=helical angle) of 0.5 or more, subsequently carrying out a solid solution treatment of the twisted aluminum article, and finally aging the thus treated aluminum article.

Further objects and advantages of this invention will become clear in the embodiments which will be given hereinafter only by way of examples to demonstrate the preferred modes. Therefore, this invention is not limited to those embodiments but permits many other modifications falling within the range and spirit of the invention.

BRIEF DESCRIPTION OF THE DRAWINGS

FIGS. 3(*a*) and 3(*b*) are graphs of a relationship found between the absorbed impact energy and the twisted angle of the test piece, in which:

FIG. 3(*a*) is the graph showing the relationship in a case wherein the test piece was subjected to the step of twisting, the solid solution treatment and the step of aging, in this order; and FIG. 3(*b*) is the graph showing the relationship in another case wherein the test piece was subjected to the solid solution treatment, and the subsequent steps of twisting and aging;

FIGS. 4(*a*) and 4(*b*) are graphs of a further relationship between the elongation and the twisted angle of the test piece, in which:

FIG. 4(*a*) is the graph showing the further relationship in a case wherein the test piece was subjected to the step of twisting, the solid solution treatment and the step of aging, in this order; and FIG. 4(*b*) is the graph showing the further relationship in another case wherein the test piece was subjected to the solid solution treatment, and the subsequent steps of twisting and aging.

DETAILED DESCRIPTION OF THE INVENTION

The heat-treated aluminum raw material includes in the present invention Al—Cu alloys (viz. 2000 series), Al—Mg—Si alloys (viz. 6000 series) and Al—Zn—Mg alloys (viz. 7000 series).

The raw articles to be twisted will generally be those which are produced by extrusion. It will be advantageous from a viewpoint of production efficiency that an aluminum billet is extruded into an elongate article which is then sliced perpendicular to the direction of extrusion. However, the raw material need not necessarily be an extruded one.

Figure 2:
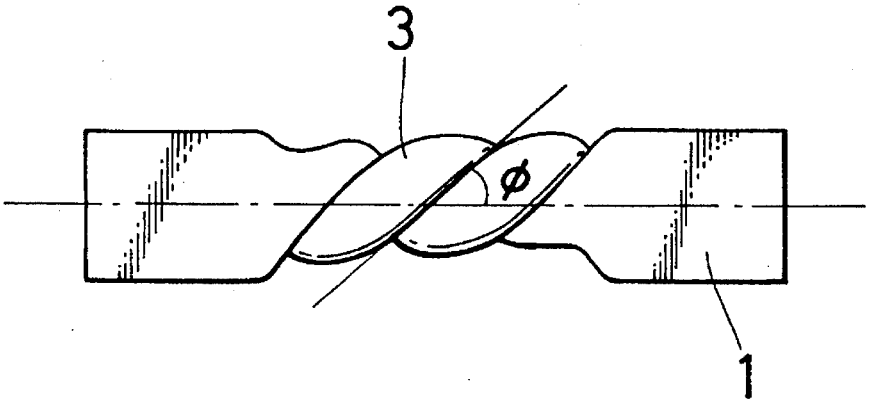
FIG. 2 is a front elevation of the test piece which was twisted.
Figure 3A:
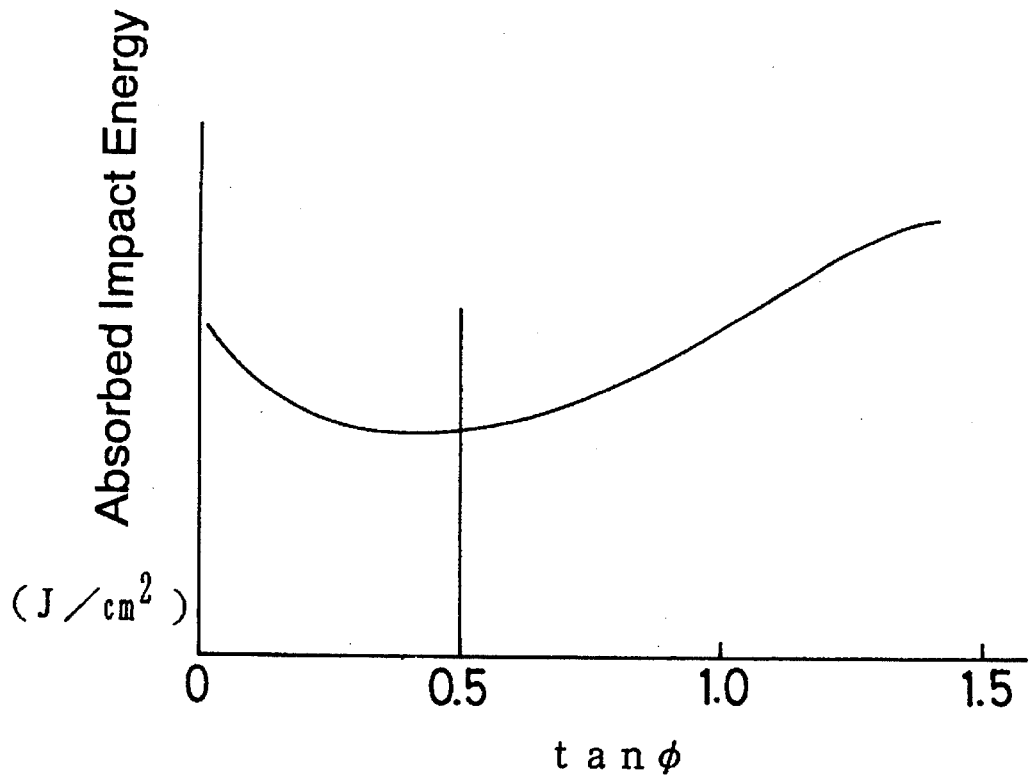
Figure 3B:
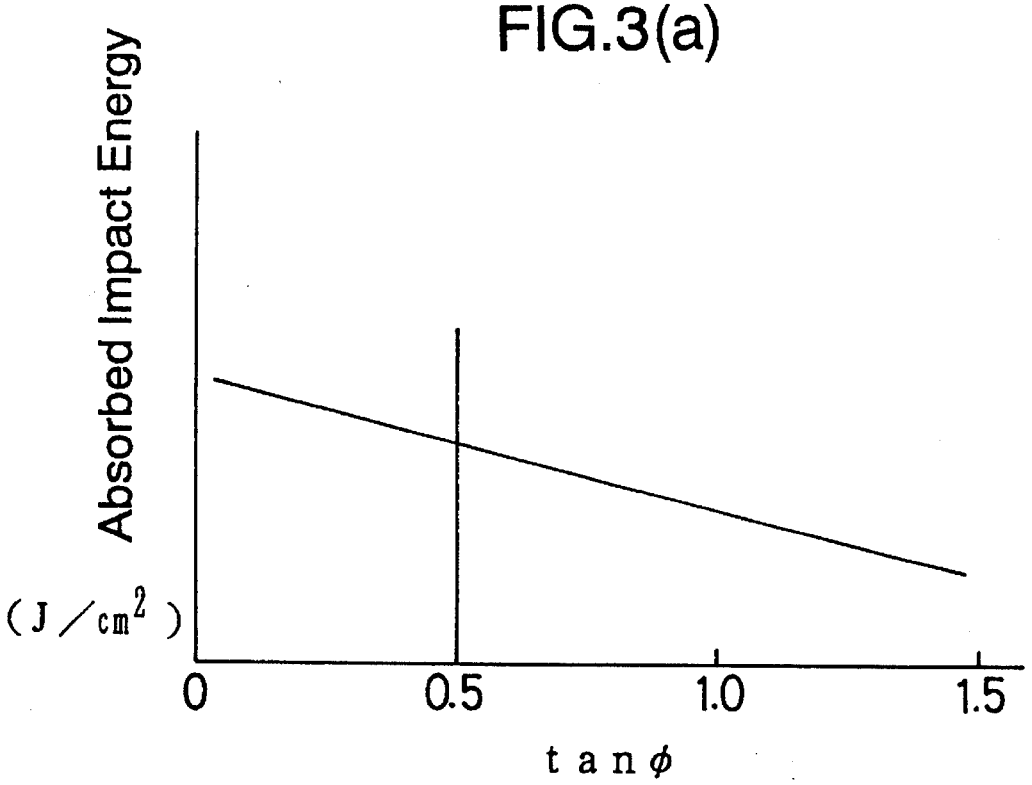
Figure 4A:
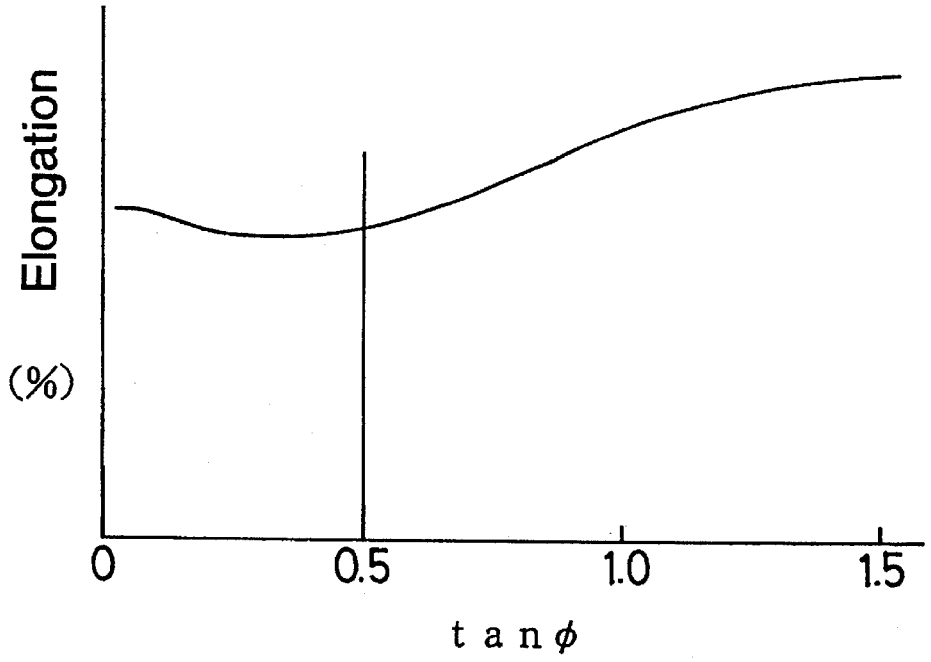
Figure 4B:
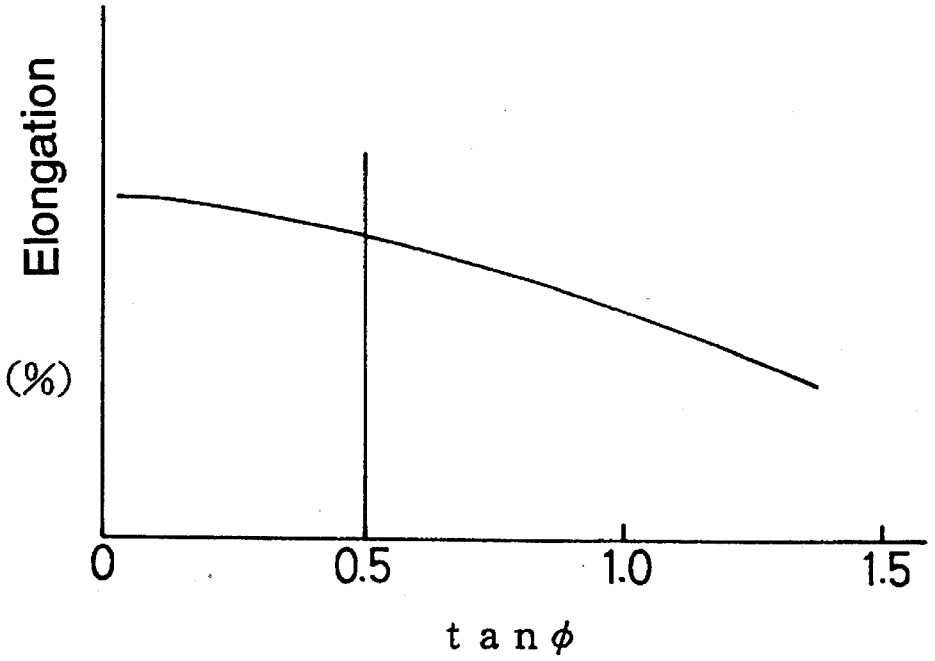
FIG.4(b) PRIOR ART

FIGS. 3(*a*) and 3(*b*) show a relationship between the impact energy absorbed by twisted aluminum articles and the helical angle thereof, and FIGS. 4(*a*) and 4(*b*) show a further relationship between the elongation and the helical angle of the articles. In these graphs, the axis of abscissas represents a value of "tan $\phi$" with the term "$\phi$" denoting the helical angle of twisted articles. A larger value thereof indicates that the articles are twisted to a greater extent. As shown in FIG. 2, the helical angle is determined between an imaginary axis of the untwisted raw article and a tangential line of helix in the twisted article.

As will be seen in FIGS. 3(*b*) and 4(*b*), a quantity of absorbed impact energy and an elongation of twisted articles decrease monotonously with the increasing of the value tan $\phi$, if the raw articles are subjected at first to the solid solution treatment, and then to the steps of twisting and aging. If the articles are twisted before subjected to the solid solution treatment and the aging, the quantity of absorbed impact energy and the elongation initially decrease until the value tan $\phi$ reaches the certain value below 0.5. After the value tan $\phi$ exceeds the above certain value, they do however turn to increase as the value tan $\phi$ approaches 0.5 and then they continue to increase as seen in FIGS. 3(*a*) and 4(*a*).

Thus, the range of tan $\phi$ below 0.5 is not preferable, because the quantity of absorbed impact energy and the elongation are low even if the twisting of raw articles is done at first. In other words, the raw articles have to be twisted to a greater extent such that the value tan $\phi$ is or exceeds 0.5, or more desirably 1.0.

Presumably, this difference in properties of twisted articles may correspond to a difference between a coarser recrystallization and a finer and isotropic one taking place during the solid solution treatment. In detail, a weaker twisting to an extent less than 0.5 (=tan $\phi$) will generate a relatively small plastic strain which in turn results in the coarser recrystallized structure in twisted articles. In contrast, a stronger twisting to an extent equal to or more than 0.5 (=tan $\phi$) contrarily generating a greater plastic strain and producing the finer recrystallized structure.

The raw aluminum articles may be twisted in any conventional manner, and under compression or tension if necessary. The twist may not necessarily be formed over the full length of each raw article, but may be restricted to any intermediate region between opposite ends.

The solid solution treatment and subsequent aging of the twisted articles may be effected under any proper conditions depending on the kind of raw aluminum and/or on the required strength. Generally, the most preferable condition for the former treatment may be the heating of twisted articles at a temperature of 450°–550° C. for 0.5–4 hours, followed by a quenching thereof in water. The aging may preferably be done at 115°–205° C. for 6 to 36 hours.

In summary, the heat-treatable raw aluminum articles are to be twisted at first to have the helical angle of 0.5 or more (in terms of tan $\phi$), before subjected to the solid solution treatment and the aging step, whereby the shock-absorbing property and elongation of the final products are improved.

THE PREFERRED EMBODIMENTS

Figure 1:
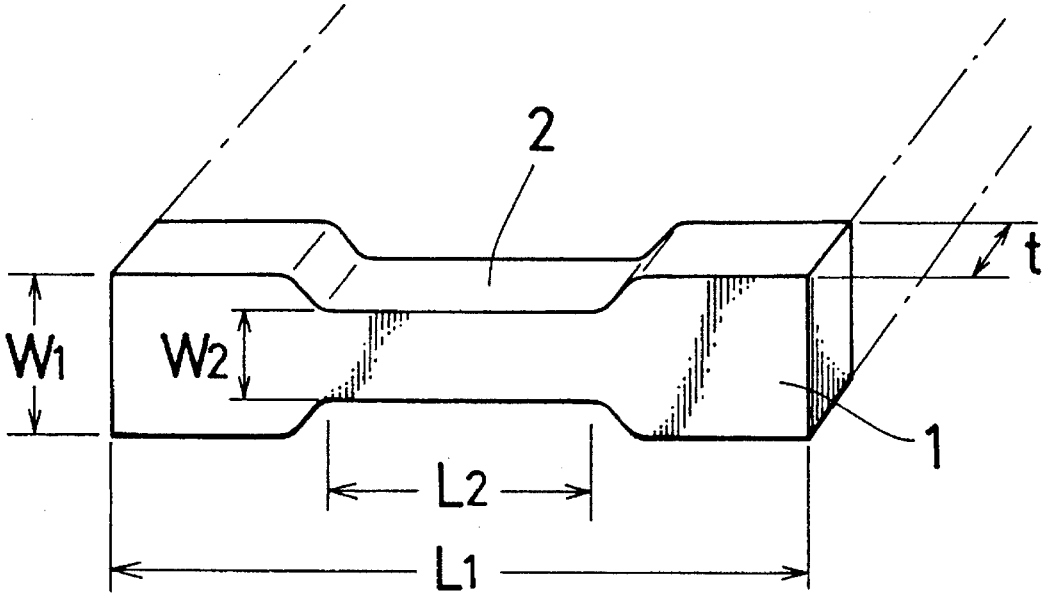
FIG. 1 is a perspective view of a test piece used in an embodiment.

An aluminum alloy of the A6061 series was extruded to give a raw elongate article having a thinner middle portion between thicker longitudinal sides, as shown in FIG. 1. This extrudate was then sliced in a direction perpendicular to the extrusion to provide test pieces 1, each having a length $L_1$ of 130 mm, a width $W_1$ of 20 mm and a thickness 't' of 10 mm. The middle portion of each test piece had a length $L_2$ of 30 mm and a width $W_2$of 10 mm.

Those test pieces 1 called 'F' articles were then subjected to the step of twisting. Their thin middle portions 3 were thus twisted in a manner as shown in FIG. 2, but to different extents as to helical angle $\phi$.

Subsequently, the twisted test pieces underwent the solid solution treatment at 520° C. for 2 hours, followed by the quenching in water, and the final aging at 170 ° C. for 10 hours.

Izod test was done for each finished test piece in order to determine the relationship between the quantity of absorbed impact energy and the value tan $\phi$. Further, tensile test was carried out to determine further relationship between the elongation and the value tan $\phi$ of test pieces. Results of those tests are schematically shown in FIGS. 3(*a*) and 4(*a*).

On the other hand, similar test pieces 1 were prepared and subjected at first to the solid solution treatment under the same condition as noted above. Then, they were twisted to have various helical angles $\phi$, and aged under the above-mentioned condition.

Izod test and tensile test were also conducted for these reference samples to give a relationship between the quantity of absorbed impact energy and the value tan $\phi$ and a further relationship between the elongation and the value tan $\phi$, respectively, as shown in FIGS. 3(*b*) and 4(*b*).

Data of the absorbed impact energy and the elongation in relation to the varied helical angles (in terms of tan $\phi$) are given in Table 1.

As seen in Table 1, with the value of tan $\phi$ being 0.5 or more, the test pieces prepared in accordance with the present invention proved excellent both in the quantity of absorbed impact energy and the elongation. Thus, a proper twisting of raw aluminum articles will not impair but rather improve their shock absorbability and elongation.

It is now apparent that the method provided herein comprises steps of twisting raw aluminum pieces to have a value of 0.5 as tan $\phi$ ($\phi$=helical angle) or more, then subjecting them to solid solution treatment and finally aging them, whereby quality of twisted aluminum articles is improved as compared with those produced by the prior art methods.

TABLE 1

| Test pieces | tan $\phi$ | Process | Absorbed impact energy (J/sq · cm) | Elongation (%) |
|---|---|---|---|---|
| Ref. 1 | 0.3 | A | 65 | 10 |
| Inv. 2 | 0.5 | A | 70 | 14 |
| Inv. 3 | 0.8 | A | 80 | 16 |
| Inv. 4 | 1.1 | A | 90 | 18 |
| Inv. 5 | 1.3 | A | 120 | 21 |
| Ref. 6 | 0.3 | B | 90 | 12 |
| Ref. 7 | 0.5 | B | 70 | 11 |
| Ref. 8 | 0.8 | B | 60 | 9 |
| Ref. 9 | 1.1 | B | 50 | 7 |
| Ref. 10 | 1.3 | B | untwistable(*) | — |

Notes:
'A' means 'twisting', 'solid solution treatment' and 'aging' carried out in this order.
'B' means 'solid solution treatment', 'twisting' and 'aging' carried out in this order.
(*) denotes a breakage of the test piece when twisted.
Inv. = Invention, Ref. = Reference

What is claimed:

1. A method of producing a twisted elongate heat-treatable aluminum article which comprises:

twisting the elongate heat-treatable aluminum article to a helical angle of $\phi$ wherein tan $\phi$ is 0.5 or more;

subsequently subjecting the twisted aluminum article to a solid solution treatment; and aging the twisted and solid solution treated aluminum article.

2. The method as defined in claim 1, wherein tan $\phi$ is 1.0 or more.

3. The method as defined in claim 1, wherein the heat-treatable aluminum article is made of an alloy selected from the group consisting of Al—Cu alloys, Al—Mg—Si alloys and Al—Zn—Mg alloys.

4. The method as defined in claim 1, wherein the solid solution treatment comprises heating the twisted aluminum article at 450°–550° C. for 0.5–4 hours and then quenching the heated article in water.

5. The method as defined in claim 1, wherein the twisted and solid solution treated article is aged at 115°–205° C. for 6 to 36 hours.

6. The method as defined in claim 1, wherein the elongate heat-treatable aluminum article is made of an alloy selected from the group consisting of Al—Cu alloys, Al—Mg—Si alloys and Al—Zn—Mg alloys, and is twisted to a helical angle of $\phi$ wherein tan $\phi$ is 1.0 or more; the twisted article is subjected to a solid solution treatment at 450°–550° C. for 0.5–4 hours; the heated article is quenched in water; and the quenched article is aged at 115°–205° C. for 6 to 36 hours.

7. A method of producing a twisted aluminum article which comprises:

extruding a heat-treatable aluminum billet to form an elongate aluminum article having an axis;

slicing the elongate aluminum article in a direction perpendicular to the axis thereof to prepare a sliced aluminum article;

twisting the sliced aluminum article to a helical angle of wherein tan $\phi$ is 0.5 or more;

subsequently subjecting the twisted aluminum article to a solid solution treatment; and aging the twisted solid solution treated aluminum article.

8. The method as defined in claim 7, wherein tan $\phi$ is 1.0 or more.

9. The method as defined in claim 7, wherein the heat-treatable aluminum billet is made of an alloy selected from the group consisting of Al—Cu alloys, Al—Mg—Si alloys and Al—Zn—Mg alloys.

10. The method as defined in claim 7, wherein the twisted article is subjected to a solid solution treatment by heating the article at 450°–550° C. for 0.5–4 hours and then quenching the heated article in water.

11. The method as defined in claim 7, wherein the twisted and solid solution treated article is aged at 115°–205° C. for 6 to 36 hours.

12. The method as defined in claim 7, wherein the elongate heat-treatable aluminum article is made of an alloy selected from the group consisting of Al—Cu alloys, Al—Mg—Si alloys and Al—Zn—Mg alloys, and is twisted to a helical angle of $\phi$ wherein tan $\phi$ is 1.0 or more; the twisted article is subjected to a solid solution treatment at 450°550° C. for 0.5–4 hours; the heated article is quenched in water; and the quenched article aged at 115°–205° C. for 6 to 36 hours.

* * * * *